US005799641A

United States Patent [19]

Reatherford

[11] Patent Number: 5,799,641

[45] Date of Patent: Sep. 1, 1998

[54] PRESSURE-WAVE SUPERCHARGER

[75] Inventor: Larry Van Reatherford, Clarkston, Mich.

[73] Assignee: Ford Global Technologies, Inc., Dearborn, Mich.

[21] Appl. No.: 732,955

[22] Filed: Oct. 17, 1996

[51] Int. Cl.[6] ..... F02B 33/42

[52] U.S. Cl. ..... 123/559.2; 417/64

[58] Field of Search ..... 123/559.2; 417/64

[56] References Cited

U.S. PATENT DOCUMENTS

| | | | |
|---|---|---|---|
| 2,970,745 | 2/1961 | Berchtold | 123/559.2 |
| 3,116,596 | 1/1964 | Boehme et al. . | |
| 4,336,856 | 6/1982 | Gamell . | |
| 4,563,997 | 1/1986 | Aoki . | |
| 5,338,158 | 8/1994 | Hauge | 417/64 |

FOREIGN PATENT DOCUMENTS

| | | |
|---|---|---|
| 62-20614A | 7/1985 | Japan . |
| 280 286 | 11/1927 | United Kingdom . |
| 2065232 | 6/1981 | United Kingdom . |

*Primary Examiner*—Michael Koczo

*Attorney, Agent, or Firm*—Donald A. Wilkinson; Roger L. May

[57] ABSTRACT

A pressure-wave supercharger for an internal combustion engine is incorporated into the engine flywheel. The supercharger includes a rotor with a plurality of cells extending axially of the rotor and arranged circumferentially about the rotor, an exhaust tube for introducing exhaust gas into the cells at one end of the rotor during rotation thereof, an ambient air inlet tube for introducing air into the cells at another end of the rotor during rotation thereof, the air introduced into the cells being compressed by the exhaust gas introduced into the cells. A compressed air inlet tube feeds the compressed air to the engine. The cells or channels of the rotor are formed within the flywheel itself such that the flywheel operates as the supercharger mechanism.

8 Claims, 4 Drawing Sheets

PRESSURE-WAVE SUPERCHARGER

TECHNICAL FIELD

The present invention relates to a pressure-wave supercharger and, more particularly, to a pressure-wave supercharger in which the engine flywheel is used as the rotor.

BACKGROUND OF THE INVENTION

Superchargers for internal combustion engines increase the air throughput of the engine by compressing the air required to combust the fuel while displacement and engine speed remain constant, thereby increasing the power of the engine. In a "pressure-wave supercharger", the power for compression is obtained from the exhaust gas.

One such supercharger for internal combustion engines is a "comprex" supercharger which is adapted to compress air directly by exhaust gas pressure and then supply the compressed air as intake air to the engine. An example of such a prior art comprex supercharger is shown in FIG. 1. This comprex supercharger 10 comprises a rotor 12 having a plurality of axially extending cells 14 arranged circumferentially about the rotor. An exhaust gas inlet 16 is arranged opposite the cells 14 at one end of the rotor 12, and an air inlet 18 is arranged opposite the cells 14 at the other end of the rotor 12. A drive means 20 drivingly couples the rotor 12 to the crankshaft 22 for rotating the rotor 12. Fresh air through the air inlet 18 is introduced into the cells 14 at the one end of the rotating rotor 12 and is compressed by the pressure of engine exhaust gas introduced into the cells 14 from the exhaust gas inlet 16 as the rotor channel passes the exhaust inlet, and the compressed air is then supplied to the cylinder 24 through the air inlet tube 26.

The drawback of such prior art comprex superchargers is that the drive means 20 and rotor 12 are parasitic add-ons which add cost and complexity to the assembly.

DISCLOSURE OF THE INVENTION

The present invention overcomes the abovereferenced drawback of the prior art design by providing a supercharger in which the rotor cells are formed directly within the engine flywheel, thereby eliminating the need for the drive means 20 and the separate rotor assembly 12 (shown in FIG. 1). In this manner, the drive means and separate rotor assembly are eliminated, and the flywheel is used as a supercharger rotor to boost the pressure of the inlet air to the cylinders.

More specifically, the present invention provides a pressure-wave supercharger for an engine having an intake manifold, an exhaust manifold, and a crankshaft. The supercharger comprises a flywheel rotatably driven about a flywheel axis with the crankshaft. The flywheel includes a plurality of channels formed therein extending across the flywheel and having first and second ends. A first exhaust tube has a first end in fluid communication with the exhaust manifold and a second end positioned adjacent the flywheel. A first air inlet tube includes a first end positioned adjacent the flywheel and a second end in fluid communication with the intake manifold. A second exhaust tube has an end positioned adjacent the flywheel. A second air inlet tube has an end positioned adjacent the flywheel. As the flywheel rotates with the crankshaft, each flywheel channel is configured to receive high pressure exhaust gas from the second end of the first exhaust tube in the first end of the channel as it rotates into alignment with the first exhaust tube, then to receive ambient pressure inlet air in the second end of the channel as it aligns with the second air inlet tube, then to deliver the inlet air to the first inlet tube through the second end of the channel when aligned with the first air inlet tube after the inlet air is pressurized by the high pressure exhaust gas, and to deliver the exhaust gas to the second exhaust tube through the first end of the channel as it aligns with the second exhaust tube after the exhaust gas has pressurized the inlet air.

Accordingly, an object of the present invention is to provide a pressure-wave supercharger which does not require an offset drive means and rotor assembly as an add-on to existing engine components.

The above object and other objects, features and advantages of the present invention are readily apparent from the following detailed description of the best mode for carrying out the invention when taken in connection with the accompanying drawings.

DETAILED DESCRIPTION OF THE PREFERRED EMBODIMENTS

The present invention eliminates the rotor 12 and drive means 20 (shown in FIG. 1) of the prior art pressure-wave supercharger. To accomplish this, the cells 14 of the prior art rotor 12 are incorporated into the flywheel 30 of the present invention.

Figure 2:
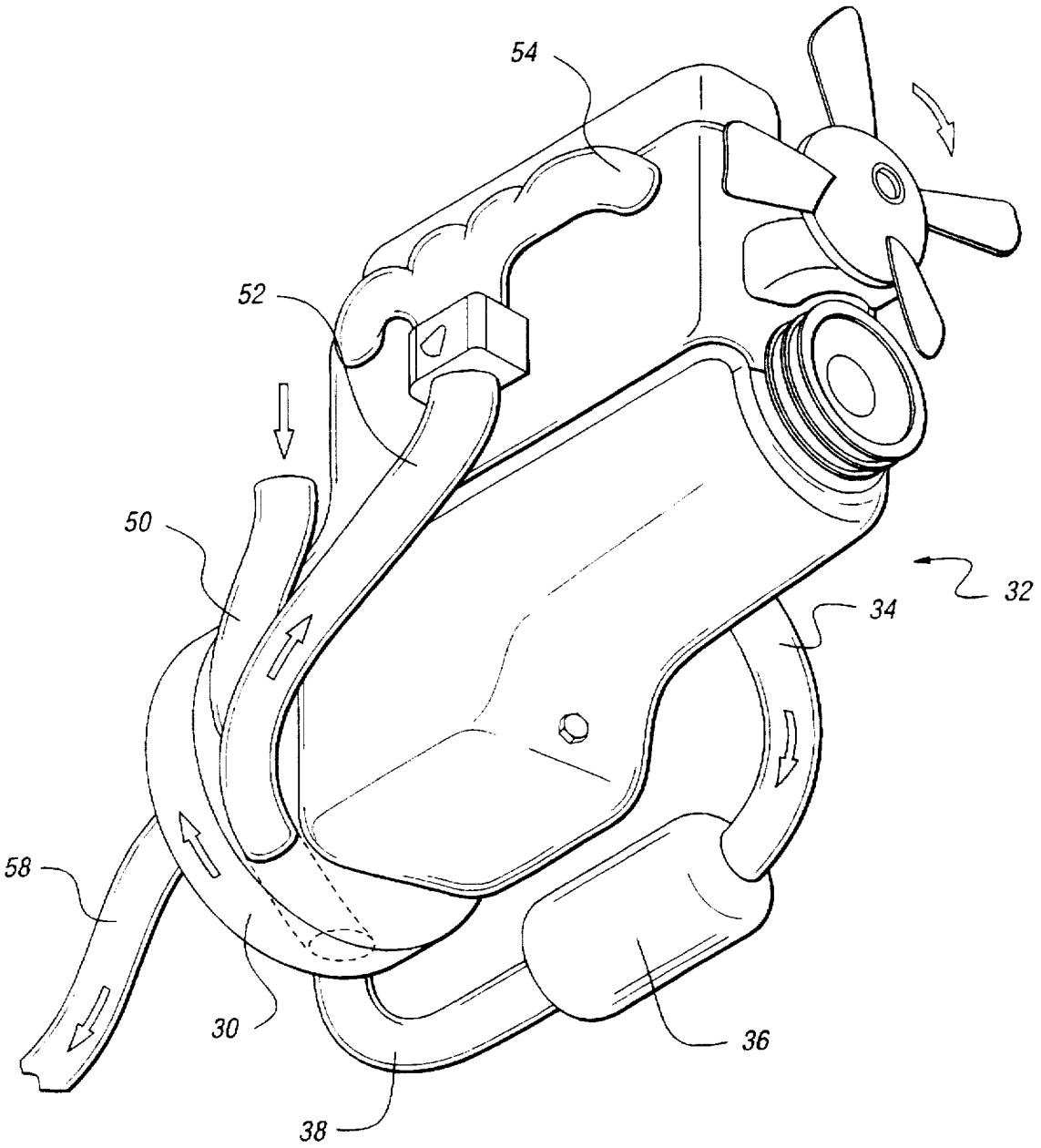
FIG. 2 shows a perspective view of an engine incorporating a supercharger in accordance with the present invention.
Figure 3:
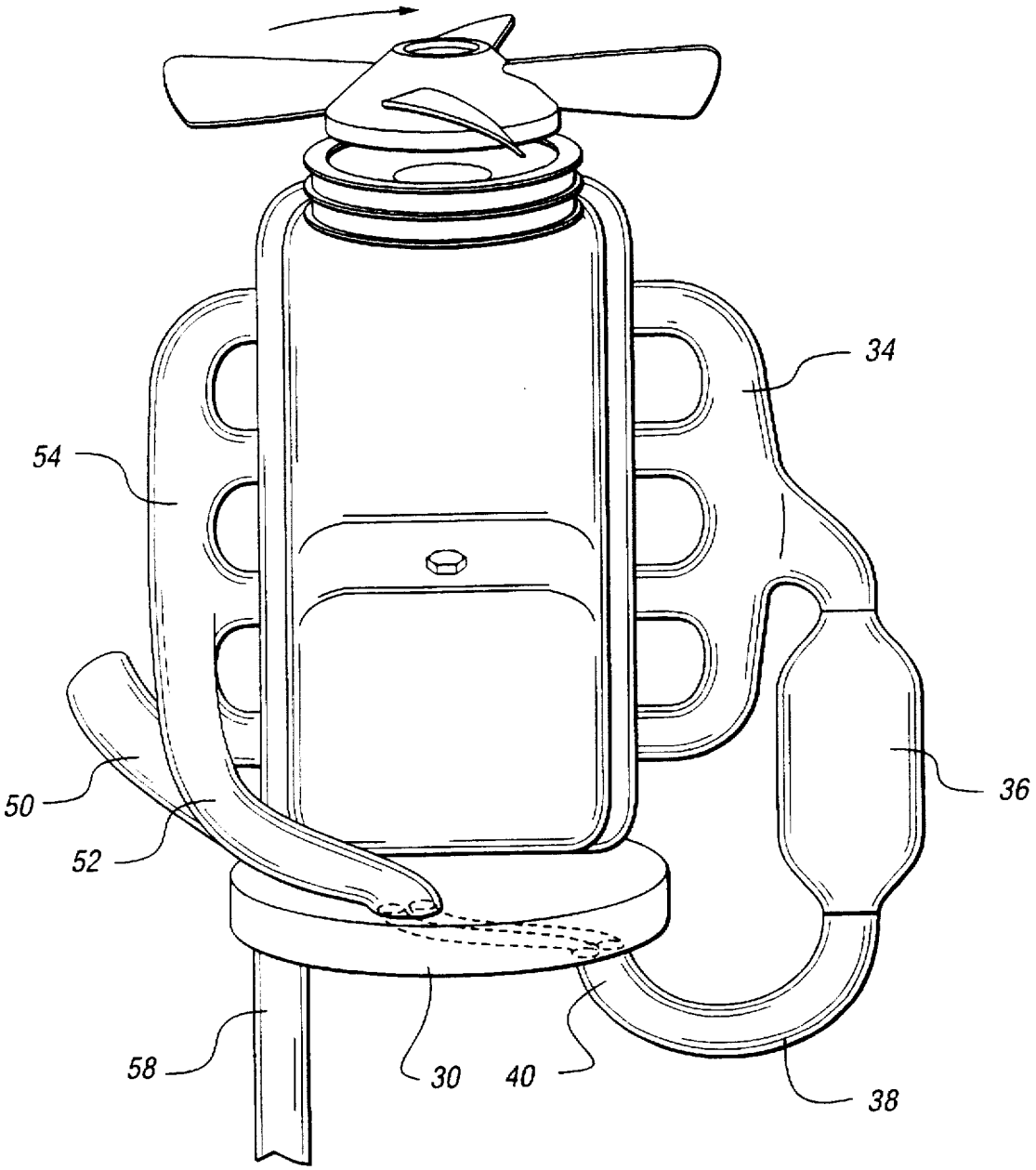
FIG. 3 shows a plan view of the engine shown in FIG. 2.

An engine 32 in accordance with the present invention, as shown in FIGS. 2 and 3, includes an exhaust manifold 34 which receives high pressure exhaust gas from the engine 32, and carries the exhaust gas to the catalyst 36 where hydrocarbons are burned off. From the catalyst 36, the first exhaust tube 38 carries the exhaust gas to the flywheel 30. The end 40 of the exhaust tube 38 is positioned closely adjacent the flywheel 30.

Figure 4:
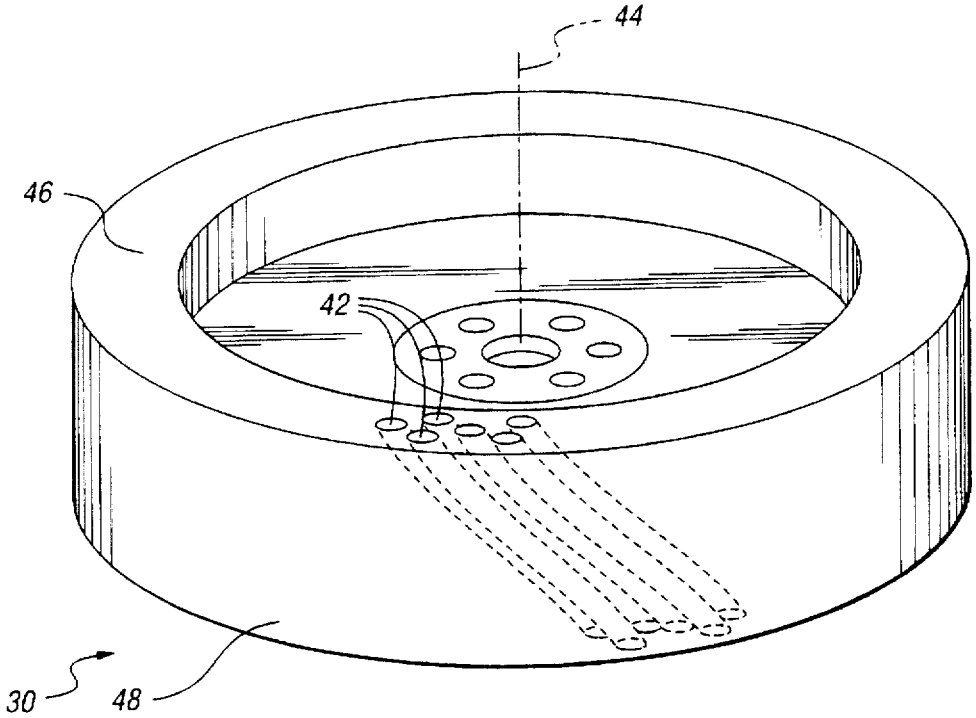
FIG. 4 shows a schematically arranged perspective view of a flywheel for use with the present invention.
Figure 5:
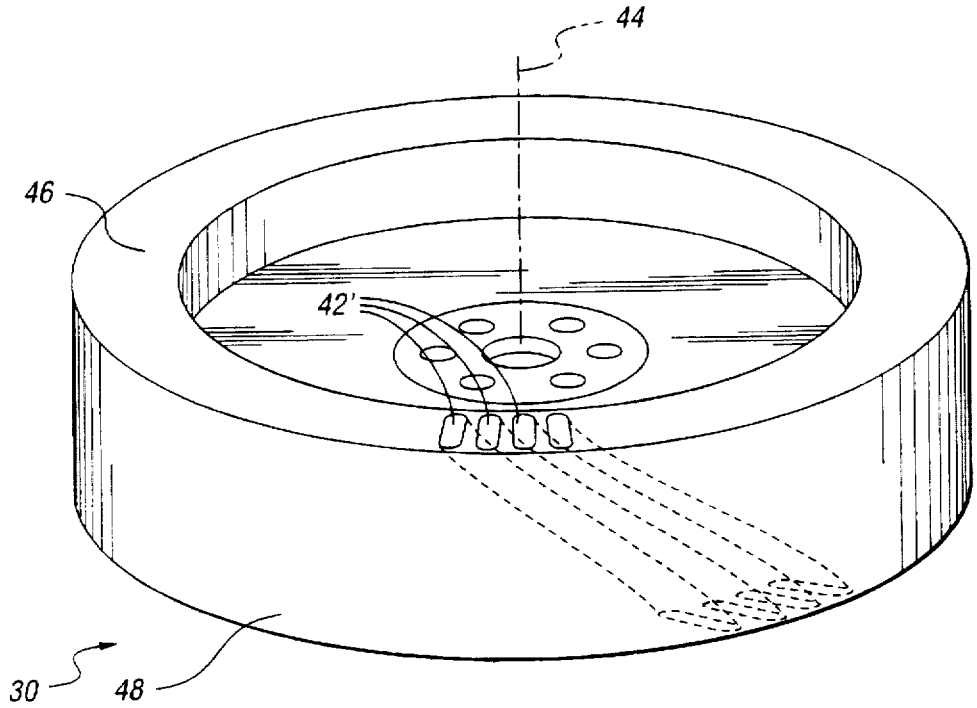
FIG. 5 shows a schematically arranged perspective view of a flywheel in accordance with an alternative embodiment of the present invention.

Turning to FIG. 4, the flywheel 30 comprises a plurality of channels or cells 42 formed therethrough at an angle with respect to the flywheel axis 44. The flywheel 30 is preferably formed of a cast aluminum material. Of course, the channels or cells 42 could be formed at varying angles with respect to the flywheel axis 44, and the channels or cells 42 could be formed in any variety of cross sections, such as elliptical, pentagonal, oblong (as in cells 42' shown in FIG. 5), etc. Alternatively, the channels 42 could extend from the side 46 of the flywheel 30 and exit the flywheel through the periphery 48. Other channel configurations are considered to be within the scope of the present invention. Such channels would be configured to accomplish appropriate entry and exit of exhaust gases and air for boosting the inlet air pressure. Manufacturing considerations would be the primary limitation.

Accordingly, the channels 42 are configured to receive exhaust gas from the end 40 of the exhaust tube 38. The exhaust gas encounters fresh air in the channels 42 which has entered through the fresh air inlet 50. The incoming exhaust gases act upon the column of air within the channel, compressing it and moving it to the opposing end of the channel 42. The compressed air then exits the flywheel channel 42 through the opposing end of the channel 42 and enters the first air inlet tube 52, which carries the compressed air to the intake manifold 54, through which the air enters the cylinders of the engine 32.

After the inlet air has been substantially forced out of the channel, the flywheel 30 continues to rotate to a position in which the flywheel chamber outlet port (corresponding with the port 56 in FIG. 1, but not shown in FIGS. 2–3) is no longer in alignment with the respective channel 42, thereby closing off the respective channel before the exhaust gas pressure front arrives at the outlet. The inertia of the moving column of exhaust gas compresses it against the closed end of the channel 42, at which time the rotation of the flywheel uncovers the end of the chamber through which the gases entered, and aligning it with the second exhaust tube 58. Since the gases are at higher pressure than the atmosphere, they reverse direction and move into the second exhaust tube 58, scavenging the channel 42 as the flywheel rotation uncovers the fresh air inlet port in communication with the inlet tube 50 at the opposite end of the channel (corresponding with the fresh air inlet port 60 shown in FIG. 1, but not illustrated in FIGS. 2–3).

The flywheel and channels continue rotation, being cooled by the inlet charge of fresh air, until the air again moves into position to be compressed by the incoming exhaust gases. Other channels within the flywheel structure sequentially move into each phase of the cycle, providing continuous boosted inlet air, the size and shape of the flywheel channels being harmonized for each engine application.

Figure 1:
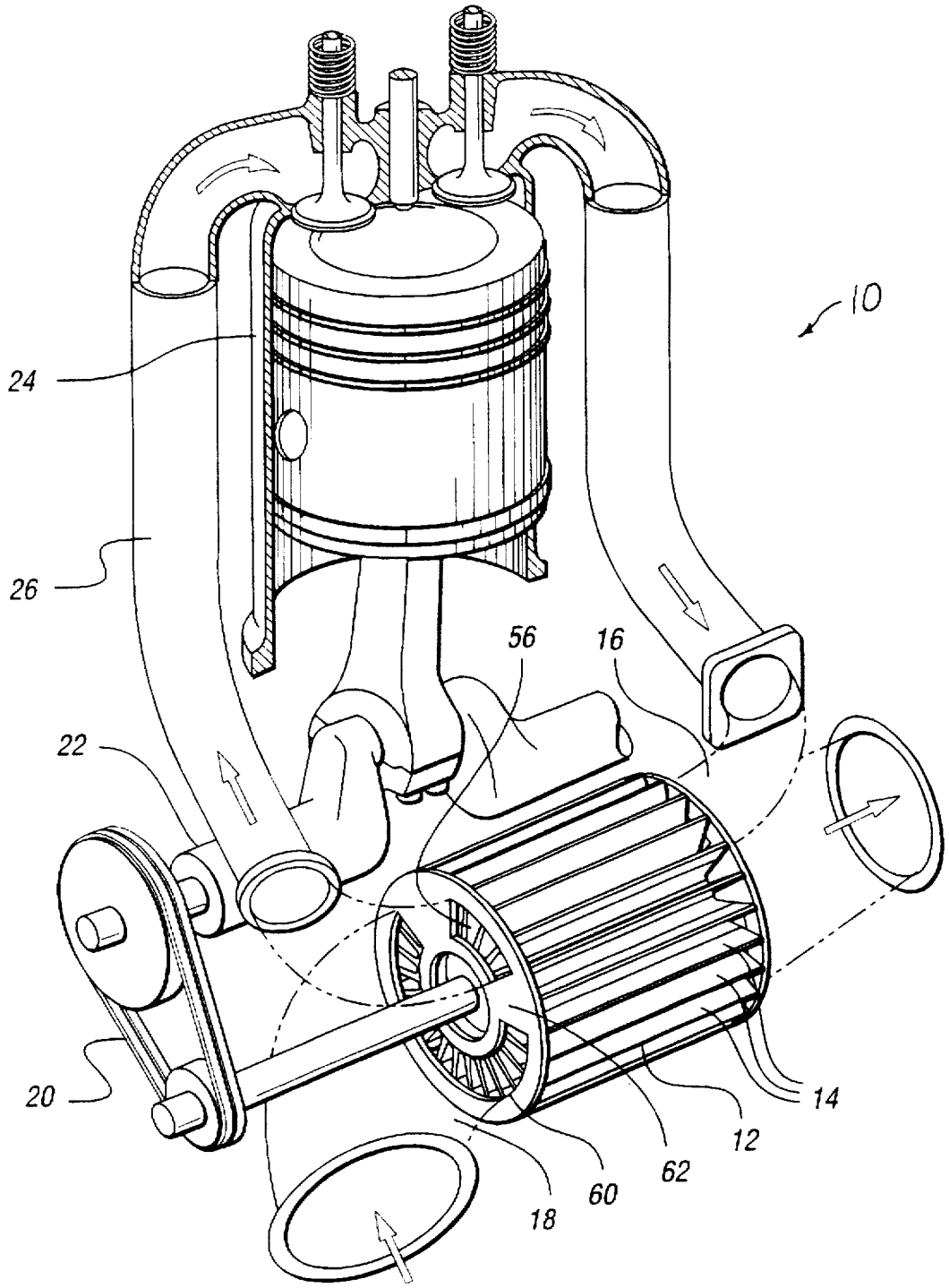
Fig. 1 (PRIOR ART)
FIG. 1 shows a schematically arranged perspective view of a prior art pressure-wave supercharger.

Of course, the flywheel 30 of the present invention must be enclosed within a bell housing or a cylindrical tube to provide the same function as the tube 62 illustrated in FIG. 1. Such housing must incorporate inlet and outlet ports on opposing ends for communication with the tubes 38,50,52 and 58, much like the configuration illustrated in FIG. 1 with respect to the prior art. The size of the inlet and outlet ports and the angle and length of the channels 42 must be properly sized and located for the particular engine application.

While the best modes for carrying out the invention has been described in detail, those familiar with the art to which this invention relates will recognize various alternative designs and embodiments for practicing the invention within the scope of the appended claims.

What is claimed is:

1. A pressure-wave supercharger for an engine having an intake manifold, an exhaust manifold, and a crankshaft, comprising:

a flywheel integrally connected with the crankshaft, the flywheel including a plurality of channels formed therein extending across the flywheel and having first and second ends;

a first exhaust tube having a first end in fluid communication with the exhaust manifold and a second end positioned adjacent said flywheel;

a first air inlet tube having a first end positioned adjacent said flywheel and a second end in fluid communication with the intake manifold;

a second exhaust tube having an end positioned adjacent said flywheel;

a second air inlet tube having an end positioned adjacent said flywheel; and wherein each said channel is configured to receive high pressure exhaust gas from said second end of said first exhaust tube in the first end of the channel, to receive ambient pressure inlet air in the second end of the channel, to deliver the inlet air to the first inlet tube through the second end of the channel after the inlet air is pressurized by the high pressure exhaust gas, and to deliver the exhaust gas to the second exhaust tube through the first end of the channel after the exhaust gas has pressurized the inlet air, as the flywheel rotates with the crankshaft.

2. The supercharger of claim 1, wherein said channels are disposed at an angle tilted with respect to said flywheel axis.

3. A pressure-wave supercharger for an internal combustion engine having a rotor, integrally connected with the crankshaft, with a plurality of cells extending axially of the rotor and arranged circumferentially about the rotor, an exhaust tube for introducing exhaust gas into the cells at one end of said rotor during rotation thereof, an ambient air inlet tube for introducing air into said cells at another end of said rotor during rotation thereof, the air introduced into said cells being compressed by the exhaust gas introduced into said cells, and a compressed air inlet tube for feeding the compressed air to the engine.

4. The supercharger of claim 3 wherein said cells are disposed at an angle tilted with respect to the rotor axis.

5. The supercharger of claim 3, further comprising an exhaust outlet tube having an end positioned adjacent the rotor for carrying the exhaust gas away from the engine.

6. A pressure-wave supercharger for an internal combustion engine, said supercharger including a rotor integrally connected with the crankshaft and having a plurality of cells extending axially of the rotor and arranged circumferentially about the rotor, an exhaust tube for introducing exhaust gas into the cells at one end of said rotor during rotation thereof, an ambient air inlet tube for introducing air into said cells at another end of said rotor during rotation thereof, the air introduced into said cells being compressed by the exhaust gas introduced into said cells, and a compressed air inlet tube for feeding the compressed air to the engine.

7. The supercharger of claim 6 wherein said cells are disposed at an angle tilted with respect to the rotor axis.

8. The supercharger of claim 6, further comprising an exhaust outlet tube having an end positioned adjacent the rotor for carrying the exhaust gas away from the engine.

* * * * *